US008573317B2

(12) United States Patent
Krüger et al.

(10) Patent No.: US 8,573,317 B2
(45) Date of Patent: Nov. 5, 2013

(54) COMPRESSED AIR FOAM TECHNOLOGY

(75) Inventors: Tino Krüger, Jüterbog (DE); Günter Dorau, Potsdam (DE)

(73) Assignee: SOGEPI S.A., Couvet (CH)

( * ) Notice: Subject to any disclaimer, the term of this patent is extended or adjusted under 35 U.S.C. 154(b) by 693 days.

(21) Appl. No.: 12/596,853

(22) PCT Filed: Apr. 24, 2008

(86) PCT No.: PCT/IB2008/001355

§ 371 (c)(1),
(2), (4) Date: Oct. 21, 2009

(87) PCT Pub. No.: WO2008/132604

PCT Pub. Date: Nov. 6, 2008

(65) Prior Publication Data

US 2010/0126738 A1 May 27, 2010

(30) Foreign Application Priority Data

Apr. 27, 2007 (EP) ..... 07008599

(51) Int. Cl.
*A62C 35/00* (2006.01)
*A62C 2/00* (2006.01)
*A62C 3/00* (2006.01)

(52) U.S. Cl.
USPC ..... 169/44; 169/8; 169/9; 169/14; 169/15; 169/46

(58) Field of Classification Search
USPC ..... 169/8, 9, 13, 14, 15, 16, 43, 44, 46
See application file for complete search history.

(56) References Cited

U.S. PATENT DOCUMENTS

| | | | | |
|---|---|---|---|---|
| 4,584,002 | A | 4/1986 | Cox et al. | |
| 5,275,763 | A | 1/1994 | Fukai | |
| 5,632,338 | A * | 5/1997 | Hunter | 169/9 |
| 5,803,596 | A * | 9/1998 | Stephens | 366/10 |
| 6,109,359 | A * | 8/2000 | Ballard | 169/14 |
| 2003/0010506 | A1 | 1/2003 | Braun et al. | |
| 2004/0177975 | A1 | 9/2004 | Laskaris et al. | |
| 2007/0209807 | A1 | 9/2007 | Kruger et al. | |

FOREIGN PATENT DOCUMENTS

| | | |
|---|---|---|
| CN | 2468514 Y | 1/2002 |
| DE | 2233176 A1 | 1/1974 |

(Continued)

OTHER PUBLICATIONS

WO 2006/000177, Kruger et al., Jan. 5, 2006.*

*Primary Examiner* — Ryan Reis
(74) *Attorney, Agent, or Firm* — Marsh Fischmann & Breyfogle LLP

(57) ABSTRACT

The method is for continuously producing compressed-air foam, notably for fire fighting or for decontamining, by supplying both compressed air and a mixture of water and at least a foaming agent to a foaming chamber (5) outputting foam to a nozzle (9) via a pipe (8). The mixture of foam agent and water and the compressed air are each continuously supplied to the foaming chamber (5) at a constant pressure and at a constant volume flow rate, e.g. by means of pressure regulators (1, 2) and of flow rate regulators (3, 4). The foam pressure is regulated at the outlet of the foaming chamber (5) for maintaining the foam mixing pressure in the foaming chamber constant, preferably by a self-operating valve (6). The foaming chamber can advantageously be of a static type comprising sieves.

17 Claims, 2 Drawing Sheets

(56) References Cited

FOREIGN PATENT DOCUMENTS

| | | | |
|---|---|---|---|
| DE | 3034622 | A1 | 1/1982 |
| EP | 1632272 | A2 | 3/2006 |
| GB | 314438 | A | 4/1930 |
| JP | 54024493 | | 2/1979 |
| JP | 2003525094 | | 8/2003 |
| JP | 2004360813 | | 12/2004 |
| JP | 2006167355 | | 6/2006 |
| WO | 9313829 | A1 | 7/1993 |
| WO | 2006000177 | A2 | 1/2006 |

* cited by examiner

COMPRESSED AIR FOAM TECHNOLOGY

FIELD OF THE INVENTION

The invention relates to a method for continuously producing compressed-gas foam, in particular compressed-air foam and a compressed gas foam system, in particular a compressed-air foam system, notably for extinguishing fire as well as a foaming chamber particularly adapted therefore.

BACKGROUND OF THE INVENTION

It is known in the art to fight fire with compressed-air foam (CAF). Typically, a foaming agent is added continuously to a water flow and the resulting flow of the mixture of foam agent and water is supplied to a foaming line or chamber which is also supplied with air pressure so as to generate foam. The foam exiting the foaming line or chamber passes through a rigid or flexible pipe to a nozzle for ejecting the foam onto the fire. The foaming line or chamber, also designated as a mixer or a mixing chamber, is usually of a static type, alternatively called motionless, i.e. without moving parts.

Compressed air foam systems (CAFS) may be mobile e.g. when mounted on a fire-emergency vehicle. They may also be fixed e.g. when used in fixed fire-security systems in tunnels for car and truck traffic.

Various technologies for producing CAF exist which are often very different from each others.

A major problem for producing CAF is to control in an appropriate way the water flow and the air flow supplied to the mixing chamber so as to provide continuously foam having adequate properties for fighting fire and that remain stable over time. The problem arises due to the fact that both the water and air supplied to the mixing chamber and the physical conditions in the pipes and nozzles for transporting and ejecting foam may vary. In particular, the CAFS may be supplied with a water flow the pressure and flow rate of which may vary over time e.g. when using water pumps. Mobile systems may be used with water sources such as hydrants available at the spot of intervention and that can thus have different pressure and flow rate characteristics. Further, the length and diameter of the pipes connected to the outlet of the mixing chamber, the type of nozzle connected at the end of the pipe, the extent of elevation of the pipe, the number of the pipes connected to the outlet of the mixing chambers, among others, may vary and influence the working conditions of the mixing chamber and thereby the foam quality.

Therefore, complex systems and processes are used for balancing the pressure of water and the pressure of air supplied to the mixing chamber or for adapting the pressure of air when the pressure of water varies.

US-A-2004/0177975 discloses a CAFS comprising a system controller for controlling an air flow control valve depending on the signals provided by a water flowmeter and an air flowmeter with a view of maintaining a ratio of air flow to foam flow based upon the user adjustable ratio input.

WO 2006/000177 discloses a CAFS in which compressed air is conducted into a foaming line via an air pressure controller and an air volume flow rate control valve. Further, produced CAF flows via a foam pressure sensor and an electro-pneumatically operated valve, that form a closed-loop control circuit for setting the foam consistency and consequently the foam quality, to the foam ejection device. Water is fed into the system via a water pressure controller and is intermixed with a foaming agent and an additive. The foaming agent-additive-water mixture flows via a water volume flow rate control valve and the foaming line into which compressed air is inserted at preset pressure and volume flow rate parameters via the air volume flow rate control valve. This document mentions that the foam quality of the CAF spread using a foam ejecting device depends on the flow rate and therefore on the dwell time of the foam in the foaming line and teaches to control it via the foam pressure determined by a foam pressure sensor using the electro-pneumatically operated valve (foam pressure control).

However, this document does not give any detail on the way of controlling the different parameters, in particular pressure, volume flow rate and speeds/dwell time of air, water and foam so as to ensure that the mixing chamber provides continuously foam of good quality for extinguishing fire. Further, the closed-loop control may be complicated to implement.

EP-A-1 632 272 discloses a CAFS for a tunnel for car and truck traffic. This document does not deal with the problem of optimizing the working conditions of the mixing chamber, but with the problem of allowing ejection of foam having a good quality despite the fact that foam is transported over long pipes. Therefore, this document teaches to set automatically the foam pressure to a given pressure behind the mixing chamber in view of preventing the foam pressure to get below a determined value at the foam-ejection device and providing thereby consistent foam still having high extinguishing property. The foam pressure behind the mixing chamber is obtained with an adjustable cross section restriction of the pipe by means of a valve controlled with respect to a pressure sensor.

However, this document does not deal at all with the problem of controlling the different parameters, in particular pressure, volume flow rate and speeds/dwell time of air, water and foam so as to ensure that the mixing chamber provides continuously foam of good quality for extinguishing fire.

SUMMARY OF THE INVENTION

The problem of the invention is to provide an improved technology for continuously producing CAF, or more generally compressed-gas foam, with a high and constant quality and which is simple to implement, notably for the purpose of extinguishing fire or decontamination of objects.

This object is achieved with a method for continuously producing compressed-gas foam, in particular compressed-air foam, notably for fire fighting or for decontamining, by supplying both compressed gas, preferably air, and a mixture of liquid, preferably water, and at least a foam agent to a foaming chamber having an outlet for outputting foam, comprising the steps of:

- continuously supplying the mixture of foam agent and liquid to the foaming chamber at a first constant pressure and at a first constant volume flow rate;
- continuously supplying the compressed gas to the foaming chamber at a second constant pressure and at a second constant volume flow rate; and
- regulating the foam pressure at the outlet of the foaming chamber for maintaining the foam mixing pressure in the foaming chamber constant.

Preferred embodiments of the method comprise one or more of the following features:

- regulating the foam pressure at the outlet of the foaming chamber for maintaining the foam mixing pressure in the foaming chamber at a determined value;
- providing the possibility to selectively adjust said determined value;
- using a self-operating valve—preferably a pinch valve—connected to the outlet of the foaming chamber for the step of regulating the foam pressure;

the self-operating valve is adapted to regulate the foam pressure at the outlet of the foaming chamber with respect to a target air pressure applied to the self-operating valve;

using a pressure regulator and a volume flow rate regulator for continuously supplying the mixture of foam agent and liquid to the foaming chamber at a first constant pressure and at a first constant volume flow rate;

using a pressure regulator and a volume flow rate regulator for continuously supplying the compressed gas to the foaming chamber at a second constant pressure and at a second constant volume flow rate;

setting the first volume flow rate for causing the superficial velocity of the mixture of foam agent and liquid in the foaming chamber to be at least 0.3 m/s, and more preferably at least 2 m/s;

setting the first volume flow rate for causing the flow speed of the mixture of foam agent and liquid in the mixing chamber to be not more than 3 m/s;

setting the second volume flow rate for causing the superficial velocity of the compressed-gas in the mixing chamber to be at least 0.3 m/s, and more preferably at least 2 m/s;

setting the second volume flow rate for causing the superficial velocity of the compressed-gas in the mixing chamber to be not more than 3 m/s;

setting the first and the second volume flow rates for providing in the mixing chamber a relative gas speed ratio greater than 0.3, more preferably greater than or equal to 0.4, and still more preferably greater than or equal to 0.5, but not more than 0.95, more preferably not more than 0.8 and more advantageously not more than 0.75;

connecting one end of a pipe to the outlet of the foaming chamber, the other end of the pipe being connected to a foam-ejecting device, wherein the hydraulic cross section of the pipe is at least equal or greater than the hydraulic cross section of the foaming chamber.

According to another aspect, the invention proposes a compressed gas foam system, in particular a compressed air foam system, comprising:

a foaming chamber having:

a first inlet port for supplying compressed gas, preferably air, to the foaming chamber, a second inlet port for supplying a mixture of liquid, preferably water, and at least one foam agent to the foaming chamber, and an outlet port for outputting foam; and a pressure-regulating arrangement connected to the outlet port for maintaining constant the foam pressure at the outlet of the foaming chamber.

Preferred embodiments of the system comprise one or more of the following features:

a pressure regulator for continuously supplying the mixture of foam agent and liquid to the foaming chamber at a first constant pressure;

a volume flow rate regulator for continuously supplying the mixture of foam agent and liquid to the foaming chamber at a first constant volume flow rate;

a pressure regulator for continuously supplying the compressed gas to the foaming chamber at a second constant pressure;

a volume flow rate regulator for continuously supplying the compressed gas to the foaming chamber a second constant volume flow rate;

the pressure-regulating arrangement comprises a self-operated valve, preferably a pinch valve;

a pipe connected to the outlet of the foaming chamber, the other end of the pipe being connected to a foam-ejecting device, wherein the hydraulic cross section of the pipe is at least equal or greater than the hydraulic cross section of the foaming chamber;

the system is designed to implement the method according to the invention.

According to yet another aspect, the invention proposes a foaming chamber adapted for producing compressed-gas foam which may advantageously be used in a CAFS. The foaming chamber according to the invention comprises:

a conduit having an inlet for compressed gas, preferably air;

an inlet for liquid, preferably water, containing at least one foam agent; and an outlet for outputting foam; and at least one sieve arranged through a cross section of the conduit.

Preferred embodiments of the foaming chamber comprise one or more of the following features:

the mesh size of the at least one sieve is selected in the range from 0.13 to 0.5 mm;

the foaming chamber comprises two sieves arranged each through a cross section of the conduit and separated by a longitudinal distance from each other; the two sieves may advantageously have the same mesh size and the distance between the two sieves may be advantageously selected in the range of 10 up to 30 times, more preferably in the range of 15 up to 25 and more advantageously equal to 20 times the mesh size of the sieve on the side of the inlets;

the meshes of the at least one sieve have a hydraulic homologous mesh diameter smaller than the average equivalent diameter of the bubbles in the expanded foam to be produced;

the inlet for compressed gas is connected to a nozzle extending in the conduit, the nozzle having radial holes for ejecting gas into the conduit perpendicularly to the mixture of foam agent and liquid stream in the conduit;

the free cross section of the at least one sieve is equal to or larger than the free cross section of the conduit.

It is advantageous to use the foaming chamber according to the invention for continuously producing compressed-gas foam, in particular compressed-air foam, notably for fire extinguishing or decontamining. So, the invention also proposes a compressed-gas system, in particular a CAFS, comprising a foaming chamber according to invention.

Within the invention as previously defined, the mentioned compressed gas can consist in a single gas, but can also be a mixture of several different gases as is the case for air. Similarly, within the invention, the mentioned liquid can consist in a single liquid, but can also be a mixture of several different liquids.

Further features and advantages of the invention will appear from the following description of embodiments of the invention, given as non-limiting examples, with reference to the accompanying drawings listed hereunder.

DETAILED DESCRIPTION OF THE INVENTION

According to the invention, CAF is continuously produced by supplying both water containing at least a foaming agent and compressed air to a foaming chamber having an outlet for outputting. The mixture of foam agent and water is continuously supplied to the foaming chamber at a first constant pressure and at a first constant volume flow rate. Similarly, the compressed air is continuously supplied to the foaming chamber at a second constant pressure and at a second constant volume flow rate. Further, the pressure in the foaming chamber—that we will call hereafter foam mixing pressure—is regulated for maintaining said foam pressure constant, regardless of the possible lower pressure in the foam transporting line(s) connected at the outlet of the foaming chamber. The mentioned continuous production of foam and the continuous supply of compressed air and of the mixture of foam agent and water relates to the case in which the CAFS in use, i.e. in particular when the foam-ejecting device such as a nozzle arranged at the end of a pipe connected to the outlet of the foaming chamber, is open. One will understand that the mentioned pressure regulation for maintaining the foam mixing pressure constant in the foaming chamber does not necessarily involve that the pressure is the same at any location through the foaming chamber. Indeed, the different parts of the foaming chamber may cause some pressure loss and as a result the pressure may differ somewhat from one location to another in the foaming chamber. It should be understood instead that as a consequence of the mentioned pressure regulation, the pressure does not substantially vary over time when considering a given location in the foaming chamber.

As a consequence, compressed air and the mixture of foam agent and water flow through the mixing chamber with each having a constant volume flow rate and a constant flow speed, independently notably of subsequent variation of pressure that may occur in the pipe(s) for transporting the foam from the foaming chamber to foam-ejecting devices. As a result, foam is continuously output by the foaming chamber with a constant quality. Further, there is no need for balancing the pressure and the volume flow rate of the compressed air and the mixture of foam agent and water.

Figure 1:
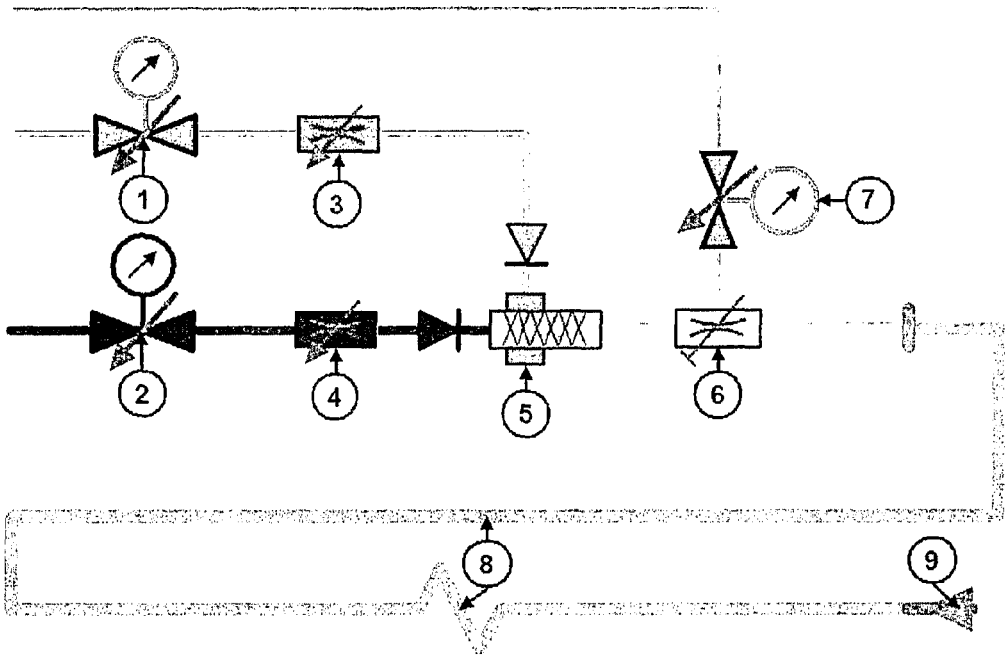
FIG. 1 shows schematically a CAFS according to an embodiment of the invention.

FIG. 1 shows a CAFS according to a preferred embodiment of the invention. The CAFS comprises a foaming chamber 5 supplied continuously with a mixture of water and at least one foam agent via a pressure regulator 2 and a volume flow rate regulator 4. The foaming agent may be of any type suitable for fire fighting. Foaming chamber 5 is also supplied continuously with compressed air via a pressure regulator 1 and a volume flow rate regulator 3. Pressure regulators 1, 2 and volume flow rate regulators 3, 4 are provided with a view of supplying foaming chamber 5 with constant pressure and volume flow rates of air and of the mixture of foam agent and water, despite possible changes in the air source and/or in the water source. Foaming chamber 5 mixes the inputted compressed air and the mixture of foam agent and water to produce foam. Foaming chamber 5 may be of any known type. Preferably, foaming chamber 5 is a static mixing chamber.

Water may be supplied from any suitable water source (not represented) such as a fire pump, a hydrant or a fixed water supply network in a building or a tunnel. Compressed air may classically be supplied by a compressor. Foaming agent is added continuously and homogeneously to water in an appropriate quantity by any appropriate technique such as described for instance in WO 2006/000177. The quantity of foaming agent added to the water is usually less than 1% of the total volume of the mixture of water and foam agent.

The outlet of foaming chamber 5 is connected to a pipe 8 for transporting the foam. A foam-ejecting device 9 such as a nozzle is connected at the end of pipe 8. Pipe 8 may be rigid or flexible according to the intended use. A pressure-regulating arrangement 6, 7 is arranged in pipe 8 at the outlet of foaming chamber 5. Pressure-regulating arrangement 6, 7 is adapted to maintain a constant pressure at the outlet of foaming chamber 5 and as a result it maintains also the foam mixing pressure in foaming chamber 5 constant. Thus, the foam mixing pressure in foaming chamber 5 does not vary due to the subsequent condition of pipe 8 and foam-ejecting device 9.

The foam pressure in foaming chamber 5 is maintained at a pressure that is set lower to the pressure of the mixture of foam agent and water and of the compressed air at the outlets of pressure regulators 1 and 2.

Maintaining the foam mixing pressure constant in foaming chamber 5 makes it possible to produce continuously foam with precisely controlled working parameters in the foaming chamber and that are stable over time. As a result, foam can be continuously produced with a constant quality. It has been found that this result is achieved due to the fact that the volume flow rates of air and of the mixture of foam agent and water that are determined by volume flow rate regulators 3, 4 set to given values are actually influenced by the difference of pressure between the inlet and the outlet of the volume flow rate regulators 3, 4. The fact of maintaining the foam mixing pressure constant in foaming chamber 5 in combination with pressure regulators 1, 2 causes the differences of pressure at the volume flow rate regulators 3, 4 to remain constant. As a consequence, the actual flow rates of air and of the mixture of foam agent and water supplied to foaming chamber 5 are constant too.

Pressure regulators 1, 2 may be pressure-limiting valves, notably of the type available on the market. Volume flow rate regulators 3, 4 may be volume flow rate regulating valves, notably of the type available on the market.

Further, pressure-regulating arrangement 6, 7 preferably comprises a self-operating valve 6, notably such as available on the market. In this case, the degree of aperture of the flow path through valve 6 is determined by the back pressure of the foam in pipe 8 and foam-ejecting device 9 in conjunction with the target pressure of valve 6.

As a result, there is no need of pressure sensors and controlling means such as a PLC or an electronic circuit with a microcontroller for achieving a constant foam pressure. In other words, a self-operating valve provides for a very simple and cheap implementation.

Self-operating valve 6 is preferably adjustable. In other words, it is possible to selectively set self-operating valve 6 to a certain target pressure according to the wished water-air ratio. And as a consequence, self-operating valve 6 regulates the foam mixing pressure in foaming chamber 5 so as to equal the target pressure. As a consequence, it is possible to change the foam mixing pressure in foaming chamber 5 and thereby adjust the flow speed.

In a preferred embodiment shown in FIG. 1, the target pressure is provided pneumatically to self-operating valve 6. The target pressure may be provided via a pressure control valve 7 connected to the compressed air source used for supplying foaming chamber 5. Alternatively, the target pressure may applied to self-operating valve 6 hydraulically, electro-hydraulically, electro-pneumatically. Self-operating valve 6 may also be designed for setting the target pressure mechanically.

It is advantageous that self-operating valve 6 be a pinch valve (also called inner tube valve). Pinch valves are known in the art. Typically, a pinch valve is a straight through valve on which the valve element consists of a flexible sleeve which is distorted to control the flow of the fluid. In operation, the pinch valve does not adversely affect the bubbles in the foam produced by foaming chamber 5 even when the degree of aperture of the valve varies e.g. as a consequence of varying conditions in pipe 8 and foam ejecting-device 9. Indeed, the pinch valve provides for a smooth—i.e. flexible—variation of the cross section through the valve. Further, the fluid path in the pinch valve is defined by smooth surfaces. As a result, the bubbles can smoothly pass through the valve without being adversely affected or destroyed as it may occur for valves having sharp edges in the flow path.

Pressure regulators 1, 2 and volume flow rate regulators 3, 4 may be respectively omitted in the case the air source and/or water source provide each the corresponding flow with the required pressure and volume flow rate.

For providing a foam of good quality and made homogeneously of tiny bubbles e.g. with an average equivalent diameter in the range of 0.5 to 1 mm, the speed of the mixture of foam agent and water flow in foaming chamber 5 is preferably at least 0.3 m/s, but more preferably at least 2 m/s. However, it is preferable that the speed thereof is not more than 3 m/s. Similarly, the speed of the compressed-air flow in foaming chamber 5 is preferably at least 0.3 m/s, but more preferably at least 2 m/s. However, it is preferable that the speed thereof is not more than 3 m/s either.

The mentioned speeds are not to be understood as actual speeds, but correspond to so-called superficial velocities that are calculated as follows:

$$V_{air}=VFR_{air}/S \quad (1)$$

$$V_{water}=VFR_{water}/S \quad (2)$$

wherein $V_{air}$: speed of the compressed air flow in foaming chamber 5, also called superficial velocity of the air in foaming chamber 5;

$VFR_{air}$: volume flow rate of the compressed air at the inlet of foaming chamber 5;

$V_{water}$: speed of the mixture of foam agent and water in foaming chamber 5, also called superficial velocity of this mixture in foaming chamber 5;

$VFR_{water}$: volume flow rate of the mixture of foam agent and water at the inlet of foaming chamber 5

S: hydraulic cross section of mixing chamber 5.

One will understand that these superficial velocities are calculated for one input flow as if the other input flow was not supplied to foaming chamber 5.

It is also preferable that the relative air speed ratio at the inlet of foaming chamber 5 is greater than 0.3, more preferably greater than or equal to 0.4. However, the relative air speed ratio is preferably not more than 0.95, more preferably not more than 0.8 and further more preferably not more than 0.75. The most preferred value of the relative air speed ratio is 0.5.

This relative air speed ratio 'R' is the ratio between the superficial velocity of the compressed-air and the sum of the superficial velocity of the compressed-air speed and the superficial velocity of the mixture of foam agent and water, these superficial velocities being those calculated above with formulae (1) and (2), i.e. R is calculated as follows:

$$R=V_{air}/(V_{air}+V_{water}) \quad (3)$$

wherein $V_{air}$ and $V_{water}$ are respectively those obtained with formulae (1) and (2) mentioned above.

Although not wanting to be bind by any theory, an explanation therefore might be that if the relative air speed ratio has a value beyond these limits, slip effects between the compressed air and the mixture of foam agent and water occur at such an extent that they do not mix correctly in foaming chamber 5 which as a result does produce foam of poor quality or even does not produce any foam.

The mentioned conditions can be met by defining adequately the hydraulic cross section of foaming chamber 5 in combination with the volume flow rates of the compressed air and of the mixture of foam agent and water at the inlet of foaming chamber 5 which are set by means of volume flow rate regulators 3, 4 under given settings of pressure regulators 1, 2 and pressure-regulating arrangement 6, 7.

For a same hydraulic cross section of foaming chamber 5 and for a same volume flow rate of compressed air supplied at the inlet of foaming chamber 5, it is possible to produce foam different from the preferred value of the relative air-speed ratio without the air speed and the speed of the mixture of foam agent and water getting out of the defined limits, by reducing the volume water flow rate supplied to foaming chamber 5. Nevertheless, it is preferable not to diminish volume water flow rate so as to reach a superficial velocity of the mixture of water and foaming agent in foaming chamber 5 below 0.3 m/s as already mentioned. As a consequence, the produced foam is more or less wet or dry according to the setting. A suitable ratio of the volume flow rate of the mixture of foam agent and water (considered at 10° C.) with respect to the volume flow rate of air considered at atmospheric pressure (considered at 0° C.)—called hereafter water air ratio—for extinguishing fire is 1:7. But this ratio can be changed, preferably within the range from 1:5 up to 1:21 notably by means of the mentioned change in settings. The CAFS may be designed to provide the user the possibility to change this ratio selectively with a control device, the CAFS changing accordingly the foam pressure and the flow rate of the mixture of foam agent and water flow by changing the setting of volume flow rate regulator 4 and pressure-regulating arrangement 6, 7.

One will understand that the foam pressure at the outlet of foaming chamber 5 is greater than the foam pressure at the inlet of foam-ejecting device 9. That difference of pressure allows the foam to be transported through pipe 8. This difference of pressure causes an expansion of the foam in pipe 8. It has been found that when the foam speed gets too high, the bubbles of the foam get destroyed due to external and internal friction as well as shearing forces. To prevent this detrimental effect, it has been found that an optimal cross section of pipe 8 can be selected in consideration of the volume flow rate and the pressure at the end of pipe 8 (at foam-ejecting device 9). In particular, it has been found that it is preferable to choose the cross section of pipe 8 at least equal or larger than the hydraulic cross section of foaming chamber 5.

Figure 2:
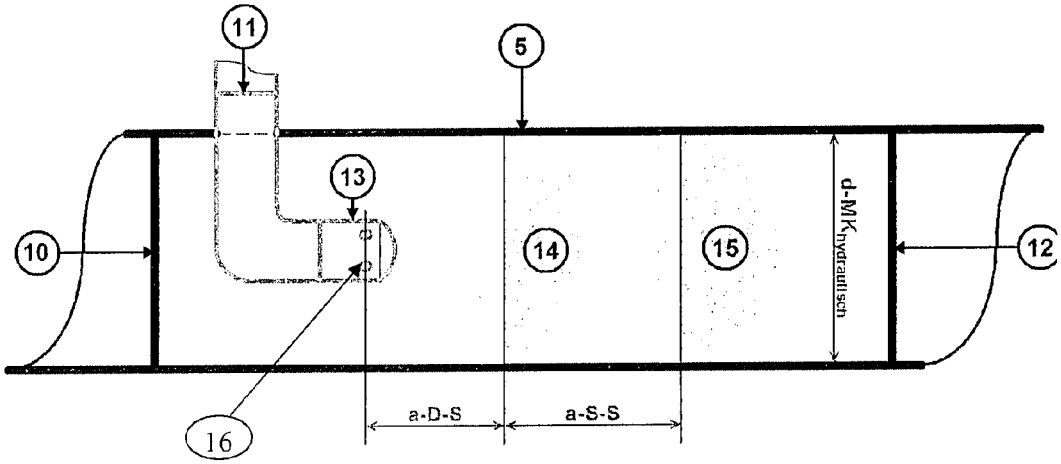
FIG. 2 shows schematically a foaming chamber according to the invention.

FIG. 2 illustrates an advantageous structure for foaming chamber 5 which provides excellent foaming performances. The foaming chamber has the form of a conduit with inlet ports 10, 11 and an outlet port 12. The cross section of foaming chamber 5 can be circular with a given diameter d-MK like in a pipe. Alternatively, the cross section may have a different shape such as a triangle or any polygon. Foaming chamber 5 is designed with a cross section so that the superficial velocities of air and of the mixture of foam agent and water remain within the limits mentioned above; see formulae (1) and (2) above.

Inlet port 10 is designed for being connected to a pipe for supplying foaming chamber 5 with the mixture of foam agent and water or alternatively a mixture of foam agent and another liquid. If used in the embodiment of FIG. 1, inlet port 10 is connected to water volume flow rate regulator 4. Inlet port 10 has preferably a cross section identical to the one of foaming chamber 5.

Inlet port 11 is designed for being connected to a pipe for supplying foaming chamber 5 with compressed air or another suitable gas according to the intended use of the foam. If used in the embodiment of FIG. 1, inlet port 11 is connected to air volume flow rate regulator 3. Inlet port 11 extends into foaming chamber 5 with a nozzle 13. Nozzle 13 is preferably located centrally of the cross section of foaming chamber 5.

Outlet port 12 is designed for being connected to a pipe transporting foam to a foam-ejecting device. If used in the embodiment of FIG. 1, outlet port 12 is connected to pipe 8 just before pressure-regulating arrangement 6, 7. Outlet port 12 has preferably the same cross section as foaming chamber 5.

Foaming chamber 5 comprises a first sieve 14 extending through a whole cross section of foaming chamber 5 at a distance a-D-S downstream of the outlet holes of nozzle 13. It preferably comprises a second sieve 15 extending through a whole cross section of foaming chamber 5 at a distance a-S-S downstream of first sieve 14. The distance a-S-S between sieves 14, 15 is preferably selected in the range of 10 up to 30 times and more preferably in the range of 15 up to 25 times the mesh size of sieves 14, and more advantageously equals 20 times the mesh size of sieves 14, 15, being mentioned that the mesh size is the hydraulic homologous (equivalent) mesh diameter. In the case the mesh size of sieve 15 is different from the mesh size of sieve 14, than the previous ranges of 10 up to 30 times and 15 up to 25 times as well as the advantageous value of 20 times are calculated with respect to the mesh size of the first sieve in the direction of the fluid flow, i.e. the sieve on the side of the inlet ports 10, 11 which is sieve 14 in FIG. 1. Further, the mesh size to be considered is an average mesh size in the case all the meshes of a sieve have not the same size. Distance a-S-S is measured between the border of the sieving section of the first sieve and the border of the sieving section of the second sieve—as shown in FIG. 2—whatever the shape or length of the longitudinal section of sieves 14, 15.

The distance a-D-S is preferably in a range of zero up to the half of the (equivalent) hydraulic diameter d-MK of conduit 5.

Sieves 13, 14 may have a different mesh or hole size. But is advantageous for them to have the same mesh or hole size. Indeed, tests have shown that when using sieves with the same mesh or hole size, the generated foam bubbles after spreading out of nozzle 9 were more homogeneous and the range of the bubble sizes of the expanded foam smaller than when using sieves with different sizes for the meshes or holes.

The meshes or holes of the sieves are defined in consideration of the size of the foam bubbles to be produced. In particular, it is preferable to select the hydraulic homologous (equivalent) mesh diameter smaller than the average equivalent diameter of the bubbles in the expanded foam to be produced. By expanded foam, it is to be understood the foam ejected at the foam-ejecting device 9. If the sieves have a different mesh size with respect to each others, the mentioned preferred hydraulic homologous (equivalent) mesh diameter applies preferably to the last sieve according to the flowing direction, i.e. to sieve 15 in the described embodiment. Generally, it is advantageous to define the mesh size of the sieves to obtain an average equivalent diameter for the bubbles in the expanded foam in the range from 0.5 to 1 mm, especially when used in fire-fighting applications. It was determined that the preferred mesh size can be determined as follows:

$$Dmesh = \frac{\sqrt{d}}{k}$$

in which:

$D_{mesh}$: is the mesh size;

d: is the hydraulic homologous diameter of the expanded bubbles; and k: is a factor ranging from 2 to 11 depending on the process parameters, especially the water-air ratio and the mixing pressure in foaming chamber 5.

Thus, the mesh size of each of sieves 14, 15 is preferably chosen within the range of 0.13 to 0.5 mm for providing bubbles in the expanded foam in the range from 0.5 to 1 mm.

Sieves 13, 14 may have different cross section shapes such as a form of a "hat", a pyramid, a spherical segment, a cone or a truncated cone. However, it is preferred that the free cross section of each sieve 13, 14 is at least equal to the hydraulic cross section of the mentioned conduit forming the surrounding wall of foaming chamber 5. This is because of the fact that the adjustment of the flow rates is done according to the preferred ranges of superficial velocities of the compressed air and of the mixture of water and foam agent. Similarly, it is also wished to set the "air speed ratio" within a certain range. So far the free cross section of the sieves is not smaller than the cross section of the conduit, it does not result in a change of these parameters. Beside the pressure loss of the stream through the sieves remains very small.

Different types of nozzles may be used for nozzle 13. Advantageously, nozzle 13 is designed with a series of radial holes 16 for ejecting air into foaming chamber 5 perpendicularly to the mixture of foam agent and water stream with a view of providing a regular distribution of air within foaming chamber 5.

The invention has been described with reference to preferred embodiments. However, many variations are possible within the scope of the invention. It is to be understood that the CAFS according to the invention can be use for other purposes than fire fighting. For example, it may be used for decontamination of objects. Of course, an appropriate foam agent is selected according to the intended use. Although the fluids mentioned in the described embodiment were air and water, the invention is not limited to these fluids. Depending on the intended use of the produced foam, air may be replaced by another gas or a mixture of gases or alternatively, air may be mixed with one or several other gases. Similarly, water may be replaced by another liquid or a mixture of several liquids or alternatively water may be mixed with one or several other liquids. In such a case, the above description made in relation to air and water applies mutatis mutantis. In particular, the mentioned conditions on superficial velocities $V_{air}$ and $V_{water}$ and on relative air speed ratio 'R' apply mutatis mutandis.

The invention claimed is:

1. A method for continuously producing compressed-gas foam for fire-fighting or for decontamining by supplying both compressed gas and a mixture of liquid and at least a foam agent to a foaming chamber having an outlet for outputting foam, comprising the steps of:

continuously supplying the mixture of foam agent and liquid to the foaming chamber at a first constant pressure and at a first constant volume flow rate;

continuously supplying the compressed gas to the foaming chamber at a second constant pressure and at a second constant volume flow rate; and regulating, in an open-loop control, the foam pressure at the outlet of the foaming chamber for maintaining the foam mixing pressure in the foaming chamber constant by applying a target gas pressure to a self-operating valve connected to the outlet of the foaming chamber, wherein the self-operating valve is adapted to regulate the foam pressure at the outlet of the foaming chamber so as to equal the target gas pressure.

2. A method according to claim 1, wherein the self-operating valve is a pinch valve.

3. A method according to claim 1, using a pressure regulator and a volume flow rate regulator for continuously supplying the mixture of foam agent and liquid to the foaming chamber at a first constant pressure and at a first constant volume flow rate.

4. A method according to claim 3, using a pressure regulator and a volume flow rate regulator for continuously supplying the compressed gas to the foaming chamber at a second constant pressure and at a second constant volume flow rate.

5. A method according to claim 1, wherein:

the first volume flow rate is set for causing the superficial velocity of the mixture of foam agent and liquid in the foaming chamber to be at least 0.3 m/s and not more than 3 m/s;

the second volume flow rate being set for causing the superficial velocity of the compressed-gas in the mixing chamber to be at least 0.3 m/s and not more than 3 m/s; and the first and the second volume flow rates are set for providing in the mixing chamber a relative gas speed ratio greater than 0.3 and not more than 0.95.

6. A method according to claim 5, using a pressure regulator and a volume flow rate regulator for continuously supplying the mixture of foam agent and liquid to the foaming chamber at a first constant pressure and at a first constant volume flow rate.

7. A method according to claim 5, using a pressure regulator and a volume flow rate regulator for continuously supplying the compressed gas to the foaming chamber at a second constant pressure and at a second constant volume flow rate.

8. A method according claim 5, wherein the first volume flow rate is set for causing the superficial velocity of the mixture of foam agent and liquid in the foaming chamber to be at least 2 m/s.

9. A method according to claim 8, wherein the second volume flow rate is set for causing the superficial velocity of the compressed-gas in the mixing chamber to be at least 2 m/s.

10. A method according to claim 9, wherein the first and the second volume flow rates are set for providing in the mixing chamber a relative gas speed ratio greater than 0.4 and not more than 0.8.

11. A method according to claim 10, wherein the first and the second volume flow rates are set for providing in the mixing chamber a relative gas speed ratio greater than 0.5 and not more than 0.75.

12. A method according to claim 11, comprising the step of:

connecting one end of a pipe to the outlet of the foaming chamber, the other end of the pipe being connected to a foam-ejecting device, wherein the hydraulic cross section of the pipe is at least equal or greater than the hydraulic cross section of the foaming chamber.

13. A method according to claim 5, wherein the second volume flow rate is set for causing the superficial velocity of the compressed-gas in the mixing chamber to be at least 2 m/s.

14. A method according to claim 5, wherein the first and the second volume flow rates are set for providing in the mixing chamber a relative gas speed ratio greater than 0.4 and not more than 0.8.

15. A method according to claim 5, wherein the first and the second volume flow rates are set for providing in the mixing chamber a relative gas speed ratio greater than 0.5 and not more than 0.75.

16. A method for continuously producing compressed-air foam for fire-fighting or for decontamining by supplying both compressed air and a mixture of water and at least a foam agent to a foaming chamber having an outlet for outputting foam, comprising the steps of:

continuously supplying the mixture of foam agent and water to the foaming chamber at a first constant pressure and at a first constant volume flow rate;

continuously supplying the compressed air to the foaming chamber at a second constant pressure and at a second constant volume flow rate; and regulating, in an open-loop control, the foam pressure at the outlet of the foaming chamber for maintaining the foam mixing pressure in the foaming chamber constant by applying a target gas pressure to a self-operating valve connected to the outlet of the foaming chamber, wherein the self-operating valve is adapted to regulate the foam pressure at the outlet of the foaming chamber so as to equal the target gas pressure.

17. A method for continuously producing compressed-air foam for fire-fighting or for decontamining by supplying both compressed air and a mixture of water and at least a foam agent to a foaming chamber having an outlet for outputting foam, comprising the steps of:

continuously supplying the mixture of foam agent and water to the foaming chamber at a first constant pressure and at a first constant volume flow rate;

continuously supplying the compressed air to the foaming chamber at a second constant pressure and at a second constant volume flow rate; and regulating, in an open-loop control, the foam pressure at the outlet of the foaming chamber for maintaining the foam mixing pressure in the foaming chamber constant by applying a target gas pressure to a self-operating valve connected to the outlet of the foaming chamber, wherein the self-operating valve is adapted to regulate the foam pressure at the outlet of the foaming chamber so as to equal the target gas pressure, the self-operating valve being a pinch valve.

* * * * *